US008615819B2

(12) United States Patent
Kerr

(10) Patent No.: US 8,615,819 B2
(45) Date of Patent: Dec. 31, 2013

(54) CERVICAL SPINE PROTECTION DEVICE

(71) Applicant: Patrick E. Kerr, New York, NY (US)

(72) Inventor: Patrick E. Kerr, New York, NY (US)

(73) Assignee: Patrick E. Kerr, New York, NY (US)

( * ) Notice: Subject to any disclaimer, the term of this patent is extended or adjusted under 35 U.S.C. 154(b) by 0 days.

(21) Appl. No.: 13/764,284

(22) Filed: Feb. 11, 2013

(65) Prior Publication Data

US 2013/0152288 A1 Jun. 20, 2013

Related U.S. Application Data

(63) Continuation-in-part of application No. 11/334,260, filed on Jan. 18, 2006, now Pat. No. 8,370,968.

(51) Int. Cl.
*A41D 13/00* (2006.01)
*A41D 27/26* (2006.01)

(52) U.S. Cl.
USPC ..... 2/468; 2/459

(58) Field of Classification Search
USPC ..... 2/459, 461, 468, 415, 411, 44, 300, 2/462; 602/18, 61, 74; 128/869, 846, 128/DIG. 23; D21/788; D29/101.2, 100; D24/191; D2/600, 602
See application file for complete search history.

(56) References Cited

U.S. PATENT DOCUMENTS 3,189,917 A * 6/1965 Sims ..... 2/415
3,497,872 A * 3/1970 Mitchell ..... 2/468
3,514,784 A * 6/1970 McDavid ..... 2/468
4,094,015 A 6/1978 Howard
4,338,685 A * 7/1982 LaPorta, Jr. ..... 2/462
4,449,251 A * 5/1984 Gauthier ..... 2/468
D277,519 S * 2/1985 Silberman ..... D29/101.2
4,501,023 A * 2/1985 Bilberry ..... 2/462
4,590,622 A * 5/1986 Wolfe et al. ..... 2/462
4,821,339 A * 4/1989 Fair ..... 2/462
4,881,529 A * 11/1989 Santos ..... 2/468
4,996,720 A * 3/1991 Fair ..... 2/462
5,287,562 A * 2/1994 Rush, III ..... 2/413
5,404,590 A * 4/1995 Monica, Jr. ..... 2/468
5,493,736 A * 2/1996 Allison ..... 2/416
5,546,601 A * 8/1996 Abeyta ..... 2/468
D419,267 S * 1/2000 Hartunian ..... D29/100
6,058,517 A 5/2000 Hartunian
6,195,802 B1 * 3/2001 Armellino ..... 2/102
6,862,749 B1 * 3/2005 Krause ..... 2/422
6,874,170 B1 * 4/2005 Aaron ..... 2/468

* cited by examiner

*Primary Examiner* — Amber Anderson
(74) *Attorney, Agent, or Firm* — Jones Day

(57) ABSTRACT

A cervical spine protection device including a lower portion engaged with a user's shoulders, and an upper portion designed for engagement with a user's helmet when an axial force is applied to a portion of the user's helmet, where the upper portion has an opening at the rearward facing side of a user's body. The device further includes a middle portion disposed between the lower portion and the upper portion, and an inside portion shaped to fit around a user's neck. The axial force applied to the top portion of the user's helmet is at least partially absorbed by the cervical spine protection device and at least partially directed away from a cervical spinal column of the user by the cervical spine protection device. The cervical spine protection device allows extension of the head and neck during athletic movement.

22 Claims, 11 Drawing Sheets

CERVICAL SPINE PROTECTION DEVICE

CROSS-REFERENCE TO RELATED APPLICATIONS

This application is a continuation-in-part of U.S. patent application Ser. No. 11/334,260, which was filed in the U.S. Patent and Trademark Office on Jan. 18, 2006, and has issued as U.S. Pat. No. 8,370,968.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

The present invention relates generally to protective gear for use in conjunction with contact sports and more particularly to a cervical spine protection device that minimizes damage to the spinal column and spinal cord while allowing substantially unrestricted movement of the head and neck during athletic activity.

BACKGROUND OF THE INVENTION

Injuries to the neck are some of the most serious injuries in contact sports. For example, hyperextension of the neck to the rear can cause permanent damage to the spinal cord and can result in paraplegia, quadriplegia, and/or other forms of paralysis. If the neck is bent excessively to one side, the nerves in the brachial plexus can be stretched to cause what is commonly known as a "pinched nerve." In severe cases, excessive lateral cervical flexion can cause permanent and irreparable damage to the nerves of the brachial plexus. Furthermore, undue flexing of the neck at an angle to the rear and to one side can result in equally serious damage to the cervical spine, brachial plexus, and/or adjacent areas of the neck and upper back.

The most serious of injuries may occur during an axial loading, when the head is driven down toward the neck and shoulders producing an excessive pressure that the cervical spine cannot handle. This pressure causes a buckling of the spinal column and may lead to disc herniation, muscle and ligament damage, and potentially spinal cord injury.

While neck injuries have been recognized as a serious problem in contact sports, very little progress has been made in developing protective athletic equipment that protects the athlete's neck without restricting their normal movement.

A number of prior art devices have been designed to reduce injuries to the necks of players in contact sports. These devices include U.S. Pat. No. 3,189,917 to Sims, U.S. Pat. No. 3,497,872 to Mitchell, U.S. Pat. No. 4,094,015 to Howard, U.S. Pat. No. 4,338,685 to LaPorta, U.S. Pat. Nos. 4,821,339 and 4,996,720 to Fair, U.S. Pat. No. 5,404,590 to Monica, U.S. Pat. No. 5,546,601 to Abeyta, U.S. Pat. No. 6,058,517 to Hartunian, and U.S. Pat. No. 6,874,170 to Aaron.

The devices exemplified by the above-mentioned references primarily attempt to reduce the flexion, extension, lateral bending, and rotation of the head. However, none of the devices disclosed in the above-mentioned references decrease axial compression of the neck without limiting the normal movement of the head of the user, nor do these references provide the degree of support provided by the embodiments of the present invention.

For example, Sims' device is elevated in the rear to contact the back portion of the helmet during the extension of the neck of the user, effectively restricting the backward movement of the head of the user. Sims' device is also tapered in the front and connected with a lace. Mitchell's device is to be worn on the top of shoulder pads. Mitchell's device is thick and four-sided with rounded edges. As appreciated by those skilled in the art, Mitchell's device prevents the normal movement of a player's neck and head. Aaron's device is attached to the helmet and shoulder pads by fasteners that inevitably restrict the normal movement of a player's head and neck. LaPorta's device has back and chest plates that are attached using a curved pad providing little or no support in minimizing damage to the spine. Howard discloses a neck cushion that is an integral part of the helmet. The back of the cushion is raised, inevitably restricting the movement of the user's head and neck.

Fair '339 and Fair '720 disclose a protective vest having a collar guard designed to engage with a player's neck or helmet with no spine protection. Hartunian discloses a foam neck brace surrounding a user's neck with 360 degrees of cushioning. The conical shape of the neck brace and the way it surrounds the neck of the user inevitably prevents the normal motion of the user. Monica discloses a helmet motion restrictor designed to engage with a football helmet of a user in order to prevent excessive lateral and posterior movements of the football helmet again restricting movement. Abeyta discloses a cervical spine protection device designed to minimize the axial compression of the head of the user, which unduly restricts the posterior and anterior movements of the neck of the user.

It is therefore an object of the cervical spine protection device of the embodiments of the present invention to reduce axial loading of the spine without limiting movement in flexion, extension, left or right lateral flexion or rotation of the skull.

It is a further object of the cervical spine protection device of the embodiments of the present invention to engage the lower most part of a helmet during axial compression so as to relieve the pressure on the spine.

It is a further object of the cervical spine protection device of the embodiments of the present invention to be worn with various types of regulation helmets and regulation shoulder pads, so as not to interfere with movement of the head of a user, or the normal workings of the helmet and/or the shoulder pads.

It is a further object of the cervical spine protection device of the embodiments of the present invention to provide a cervical spine protection device that is simple to use, lightweight, and economical to construct.

SUMMARY OF THE INVENTION

The embodiments of the present invention include a cervical spine protection device including a lower portion engaged with a user's shoulders, and an upper portion designed for engagement with a user's helmet when an axial force is applied to a top portion of the user's helmet, where the upper portion has an opening at the rearward facing side of a user's body. The device further includes a middle portion disposed between the lower portion and the upper portion, and an inside portion shaped to fit around a user's neck. The axial force applied to the top portion of the user's helmet is at least partially absorbed by the cervical spine protection device and at least partially directed away from a cervical spinal column of the user by the cervical spine protection device. The cervical spine protection device allows extension of the head and neck during athletic movement.

Yet another embodiment of the present invention is directed to a cervical spine protection system including shoulder pads, and a cervical spine protection device. The cervical spine protection device includes a lower portion engaged with a user's shoulders, and an upper portion designed for engagement with a user's helmet when an axial force is applied to a top portion of the helmet, the upper portion having an opening at the rearward facing side of a user's body. The cervical spine protection device further includes a middle portion disposed between the lower portion and the upper portion, and an inside portion shaped to fit around a user's neck. The axial force applied to the top portion of the helmet is at least partially absorbed by the cervical spine protection device and at least partially directed away from a cervical spinal column of the user by the cervical spine protection device. The cervical spine protection device allows extension of the head and neck during athletic movement.

The embodiments of the present invention further include a cervical spine protection device including an inside portion shaped to fit around a user's neck, and an outside portion with an upper portion, a lower portion, and a middle portion, where the middle portion is located between the upper portion and the lower portion. The cervical spine protection device further includes a front portion and a back portion. The lower portion is shaped to engage with a user's shoulders. The back portion includes an opening that is sized and shaped to allow a user to move their head and neck backwards without substantial restriction. The outside portion includes a substantially c-shaped design, with the lower portion and the upper portion extending laterally further than the middle portion away from the user's neck. When a force is applied to a top surface of the upper portion, the device directs the force away from the user's cervical spine.

BRIEF DESCRIPTION OF THE DRAWINGS

Preferred features of the embodiments of the present invention are disclosed in the accompanying drawings, wherein similar reference characters denote similar elements throughout the several views, and wherein.

DETAILED DESCRIPTION

Figure 1:
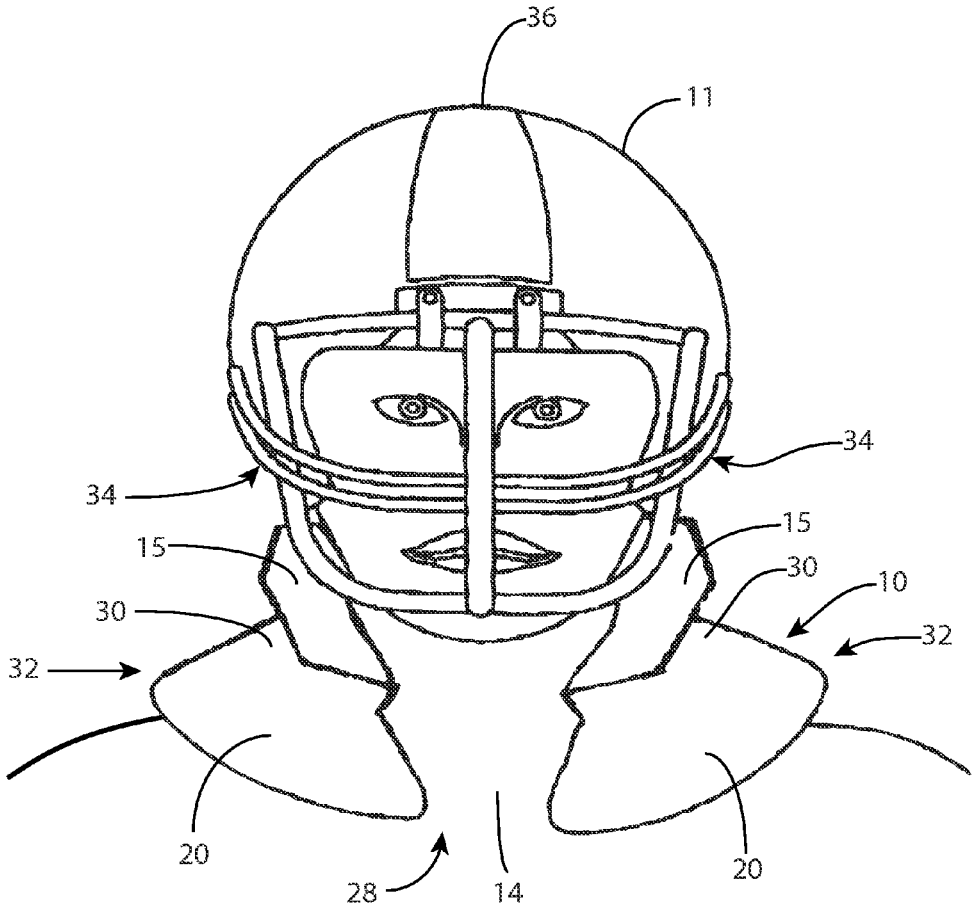
FIG. 1 is a front view of a cervical spine protection device according to an embodiment of the present invention as worn in conjunction with a football helmet.
Figure 2:
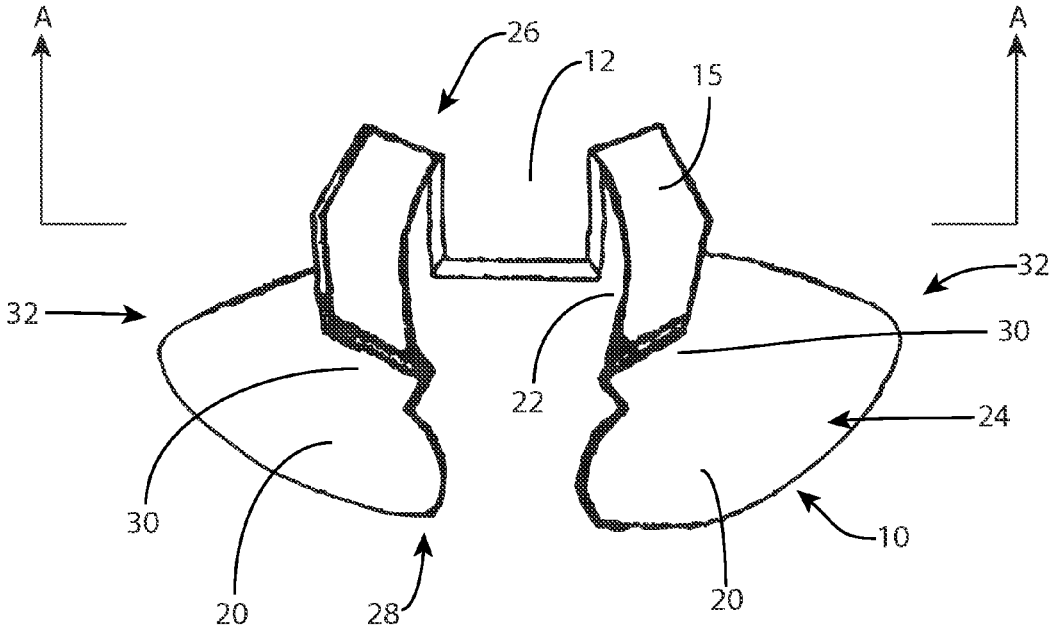
FIG. 2 is a front view of a cervical spine protection device according to an embodiment of the present invention.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "side," "upper," "lower," "front," "back," and the like, are words of convenience and are not to be construed as limiting terms.

The embodiments of the present invention are directed to a cervical spine protection device that minimizes damage to the spinal column and spinal cord while allowing substantially unrestricted movement of the head and neck during athletic activity.

The cervical spine protective device of the embodiments of the present invention is designed to reduce the possibility of neck injuries in contact sports, without restricting the normal neck movement of a player during collision. In a preferred embodiment, the device of the present invention contacts the lower most parts of the sides of a player's helmet, and has a shape that is molded to the normal anatomy of the upper back and lower cervical spine. Force received at the top of the helmet is applied to the protective device, absorbed by the protective device, and directed away from the cervical spinal column while allowing extension of the head and neck. It is a feature of the embodiments of the present invention that the device directs axial force away from the spine area. Though the embodiments of the present invention reduce axial load in an attempt to reduce forces from the head toward the neck, one skilled in the art will understand that there is no way to protect the neck and spine in all incidences of collision from injury.

Neck injuries in contact sports can vary from the rare catastrophic event, to the much more frequent but less severe neck stinger. Specifically, brachial plexopathy, known as a stinger or burner, is a common injury in contact sports, particularly in competitive football. Studies have shown lifetime injury incidences from 49% to 65% in college football. As a result, many players wear neck collars to prevent such injuries. A stinger is most likely caused by damaging the upper trunk of the brachial plexus, which is made up of the C5 and C6 nerve roots. This group of nerves runs from the cervical spine through the shoulder and into the upper arm, traveling directly under the clavicle. Stingers usually involve excessive hyperextension or lateral flexion of the head due to an impact, either with another player or with the ground. Symptoms include numbness, pain, or a stinging or burning sensation in the shoulder and/or arm. Usually, these symptoms resolve within minutes. However, this simple neuropraxia can escalate into an axonotmesis (damage to the axon or myelin sheath) that lasts for days or months, or a neurotmesis (complete disruption of the nerve), which is permanent.

Severe injuries often result from axial loading injuries. When the neck is flexed 30 degrees from anatomic position, the normal cervical lordosis is straightened and the vertebrae align into a segmented column. An impact to the head will result in a crushing of the vertebrae, with the surrounding soft tissues unable to absorb the impact (Torg, 1990). Such impacts usually result in paralysis or death.

Figure 3:
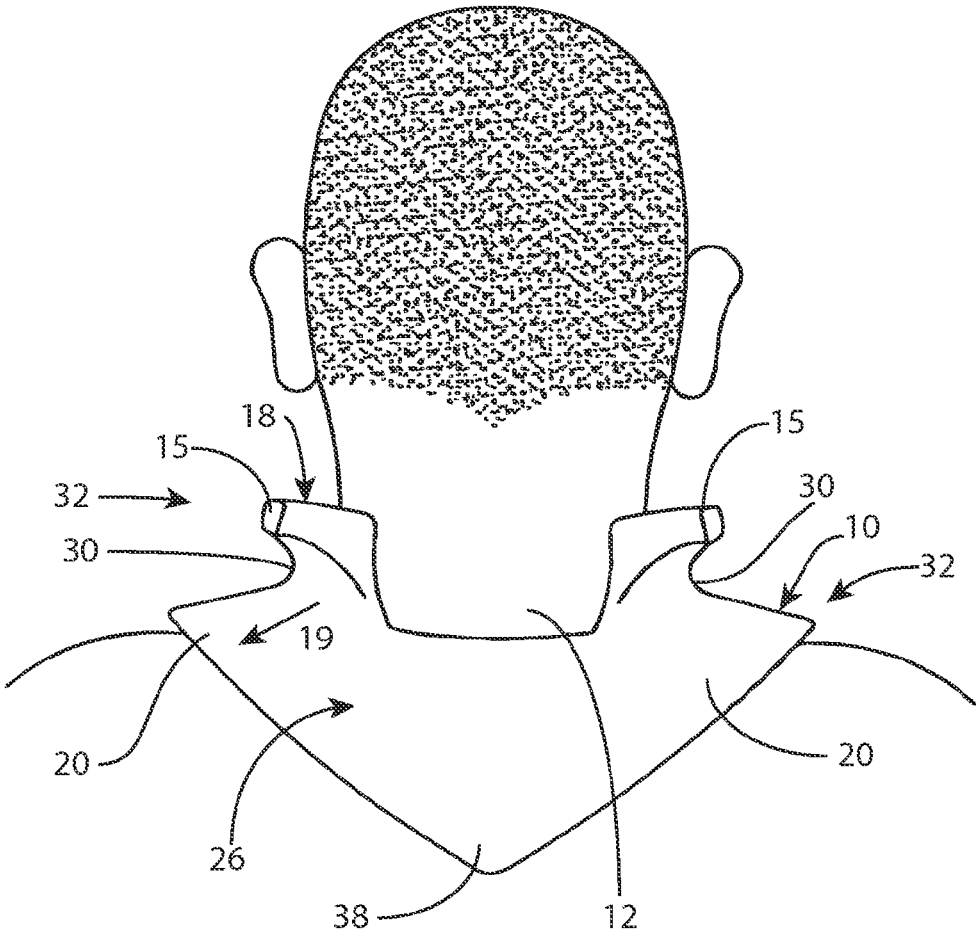
FIG. 3 is a rear view of a cervical spine protection device according to an embodiment of the present invention as worn by a user.
Figure 4:
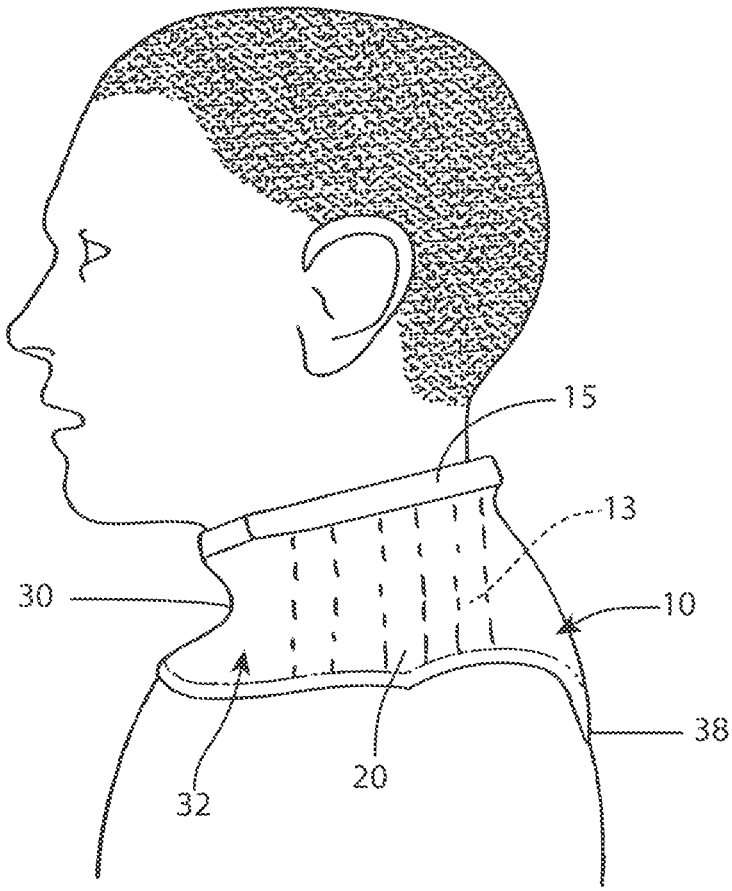
FIG. 4 is a side view of a cervical spine protection device according to an embodiment of the present invention as worn by a user.

Referring now to the Figures, FIG. 1 illustrates a front view of a cervical spine protection device 10 according to an embodiment of the present invention as worn by a user (shown as a football player in the figures). FIGS. 3 and 4 illustrate respectively a rear and side view of the device of FIG. 1. The device 10 can be constructed of various materials including plastic, polyurethane, foam, or the like (or a combination of the aforementioned materials or the like). It is to be understood that the device 10 can come in different sizes depending on the neck size of the player or other relevant factors (for example, including but not limited to, the sport being played by the intended user). The embodiments of the present invention may include materials having different densities. For example, a device according to an embodiment of the present invention may be denser than another embodiment of the present invention. The embodiments of the present invention may include varying densities throughout the device. For example, an embodiment of the present invention may include an upper portion 15 that is less dense than a lower portion 20. Additionally, an embodiment of the present invention may include an upper portion 15 that is less dense than a middle portion 30, which is in turn less dense than a lower portion 20. Moreover, a middle portion 30 may be more or less dense than the upper portion 15 and/or lower portion 20. Further, for example, an embodiment of the present invention may include an upper portion 15 that is denser than a lower portion 20. The densities of the device 10 may vary for reasons including, but not limited to, application (e.g., sport, position), user preference, injury history, or the like. One skilled in the art will recognize that the densities and varying densities of the device 10 are not limited to the specific embodiments described herein.

Figure 7:
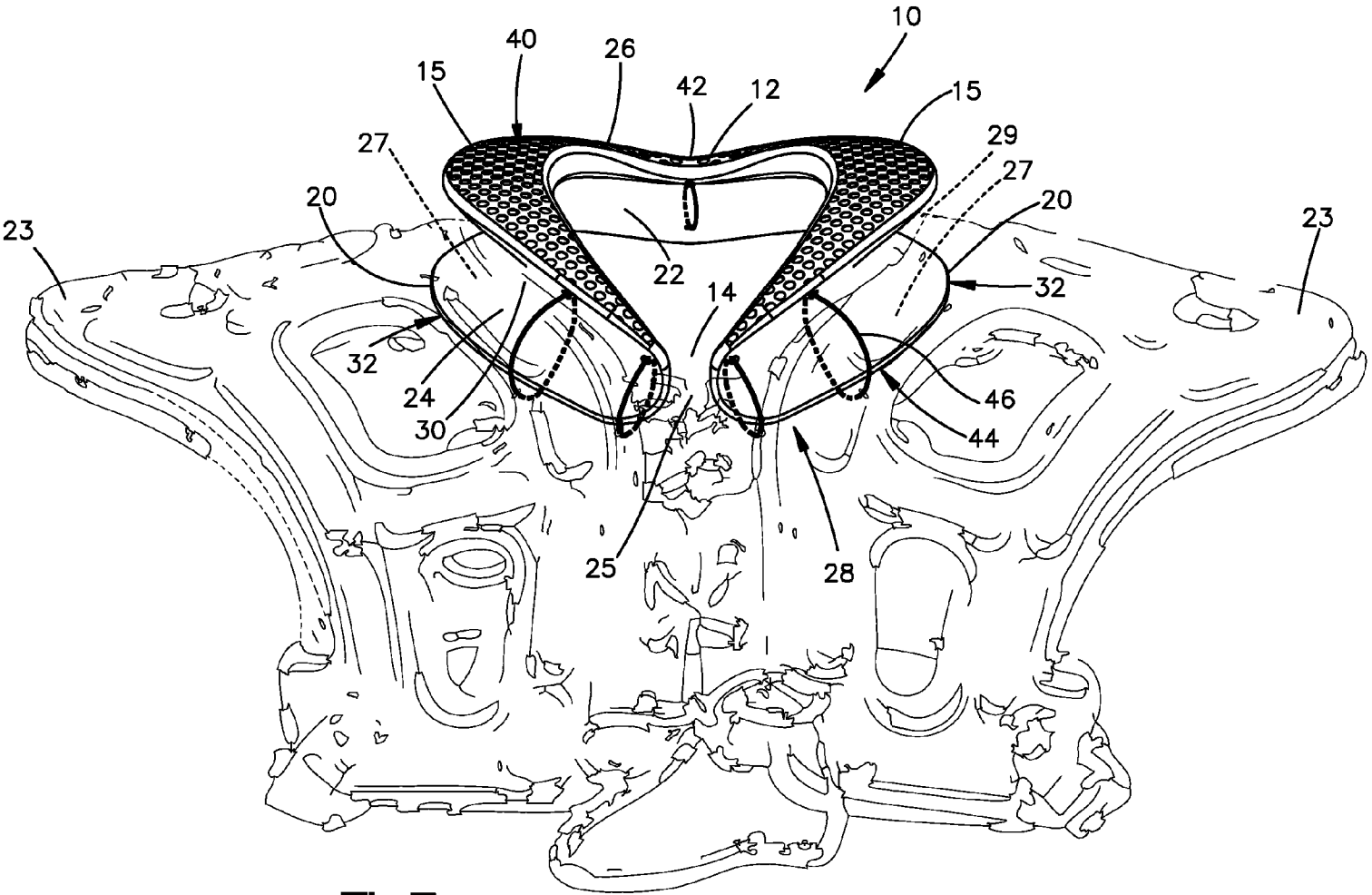
FIG. 7 is a front view of a cervical spine protection device according to an embodiment of the present invention as worn in conjunction with shoulder pads.
Figure 8:
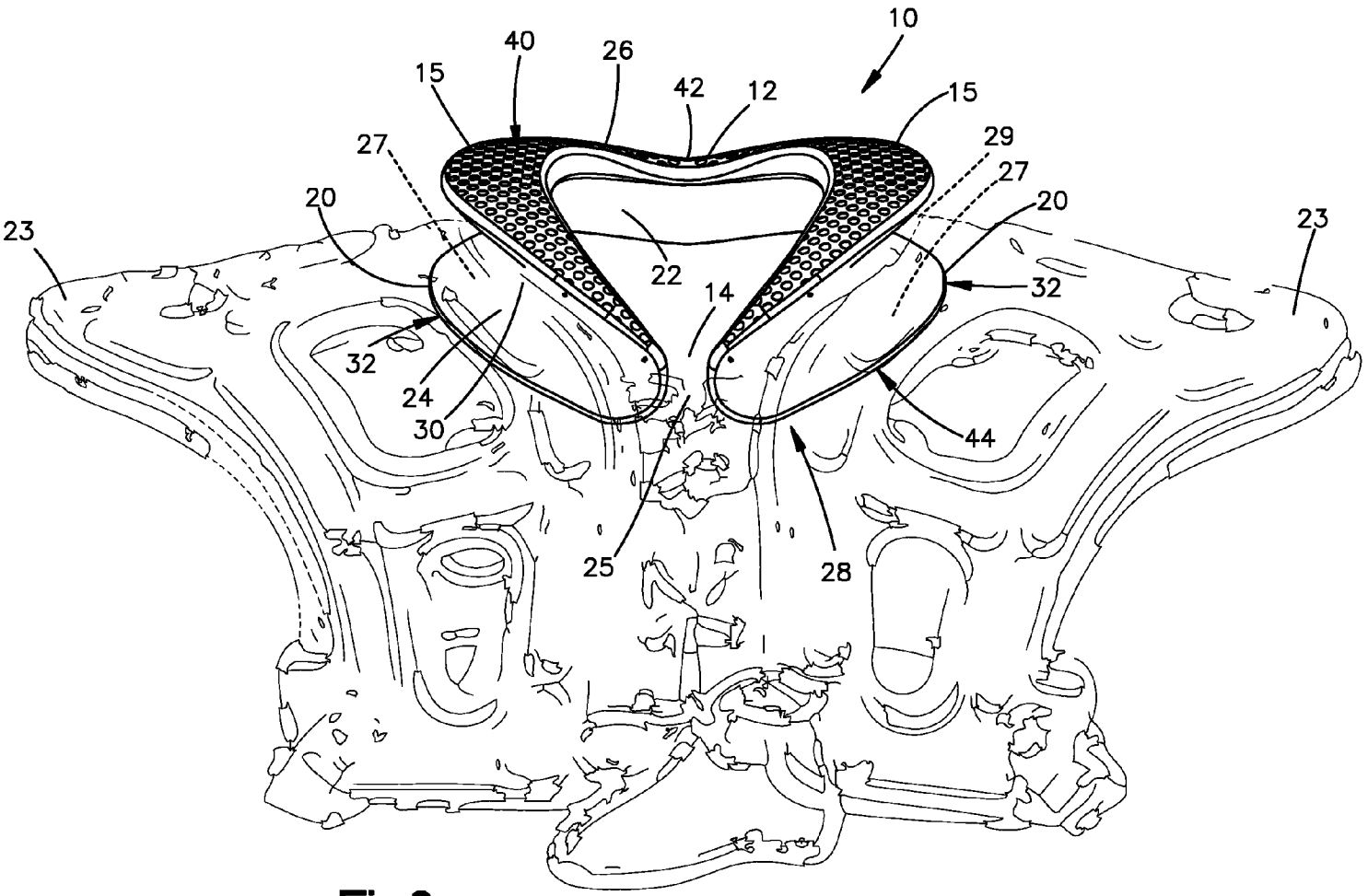
FIG. 8 is a front view of a cervical spine protection device according to an embodiment of the present invention as worn in conjunction with shoulder pads.
Figure 10:
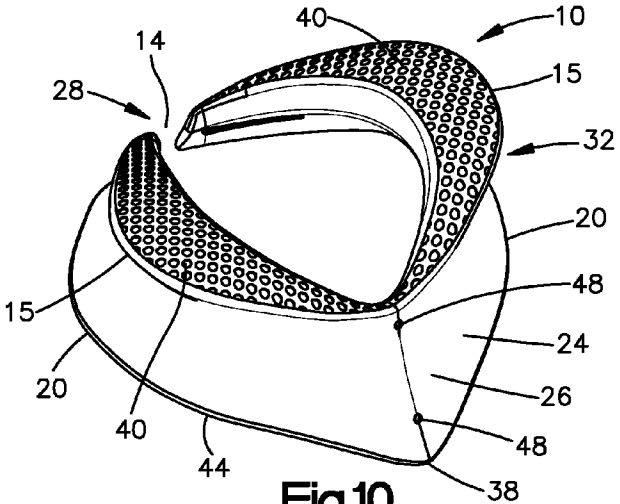
FIG. 10 is a rear/side/top perspective view of a cervical spine protection device according to an embodiment of the present invention.
Figure 9:
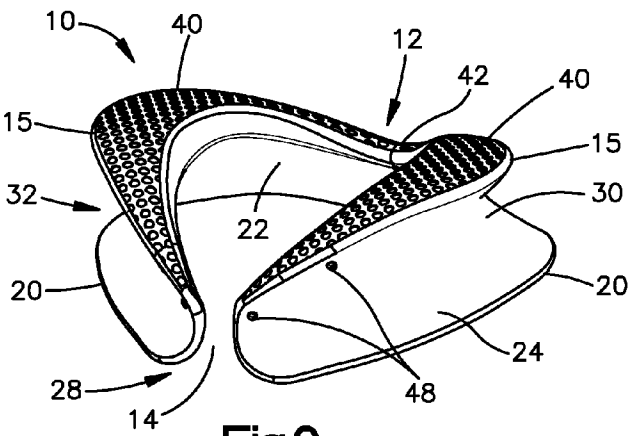
FIG. 9 is a front/side perspective view of a cervical spine protection device according to an embodiment of the present invention.
Figure 12:
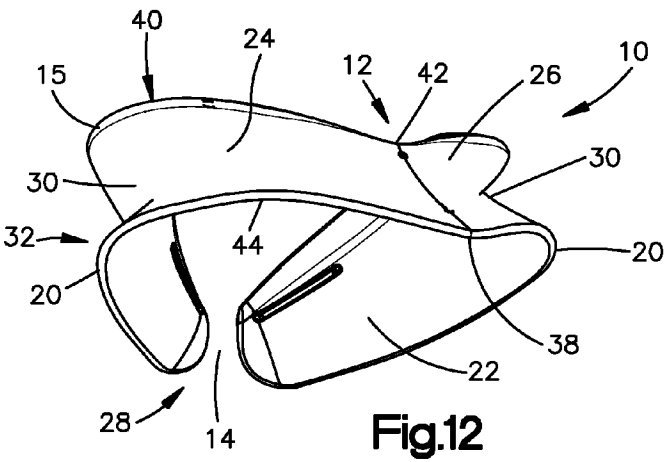
FIG. 12 is a rear/side/bottom perspective view of a cervical spine protection device according to an embodiment of the present invention.
Figure 11:
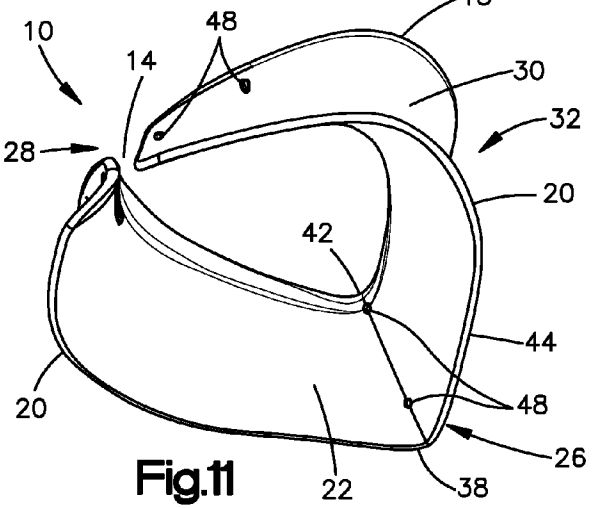
FIG. 11 is a front/side/bottom perspective view of a cervical spine protection device according to an embodiment of the present invention.
Figure 13:
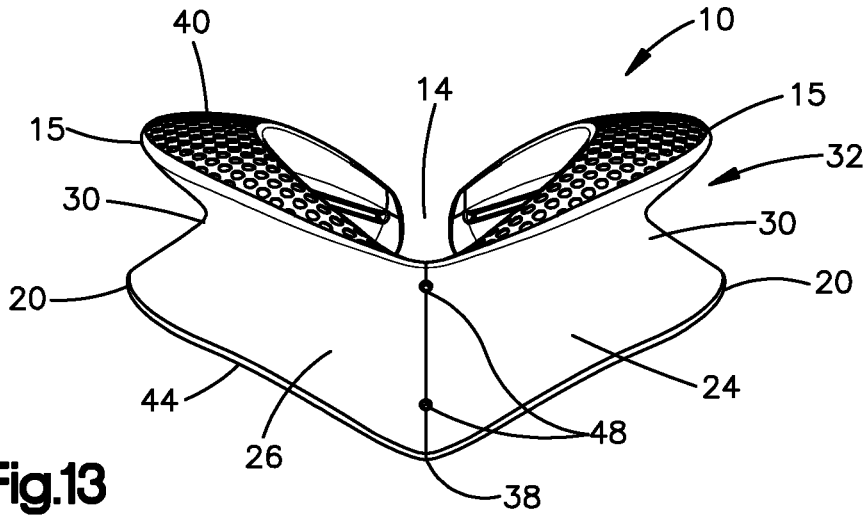
FIG. 13 is a rear view of a cervical spine protection device according to an embodiment of the present invention.
Figure 14A:
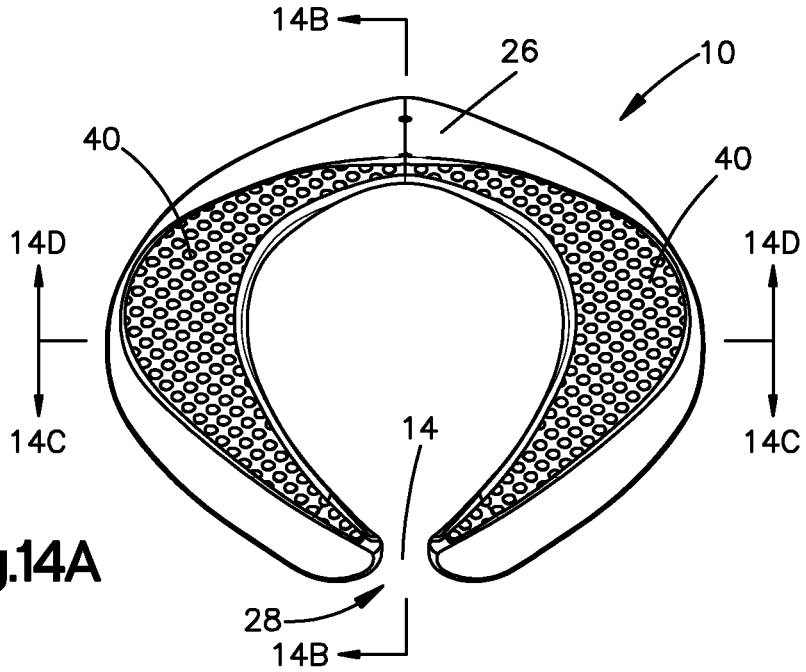
FIG. 14A is a top view of a cervical spine protection device according to an embodiment of the present invention.
Figure 14B:
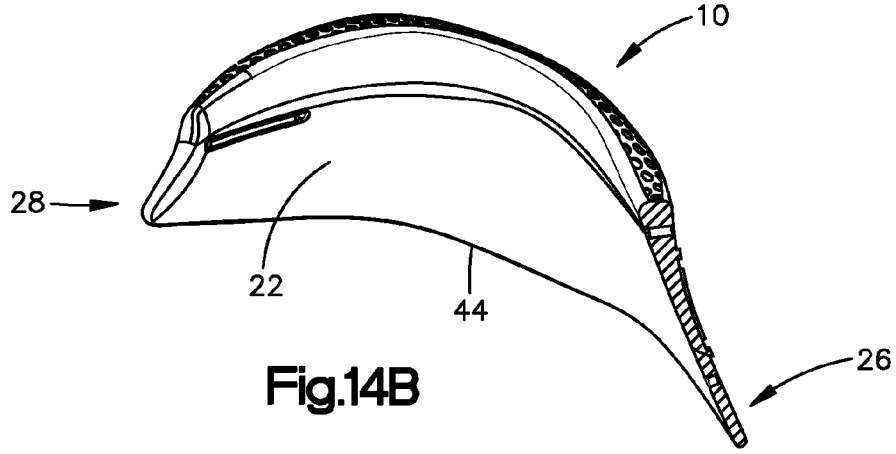
FIG. 14B is a cross section of a cervical spine protection device according to an embodiment of the present invention along line 14B-14B of FIG. 14A.
Figure 14C:
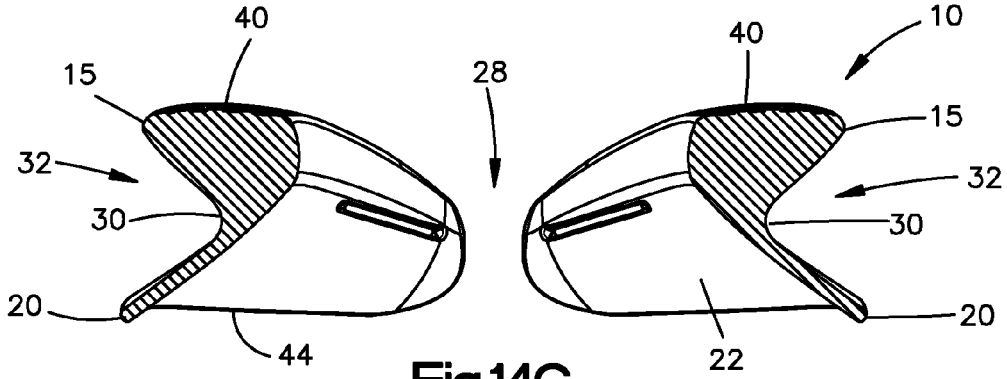
FIG. 14C is a cross section of a cervical spine protection device according to an embodiment of the present invention along line 14C-14C of FIG. 14A.
Figure 14D:
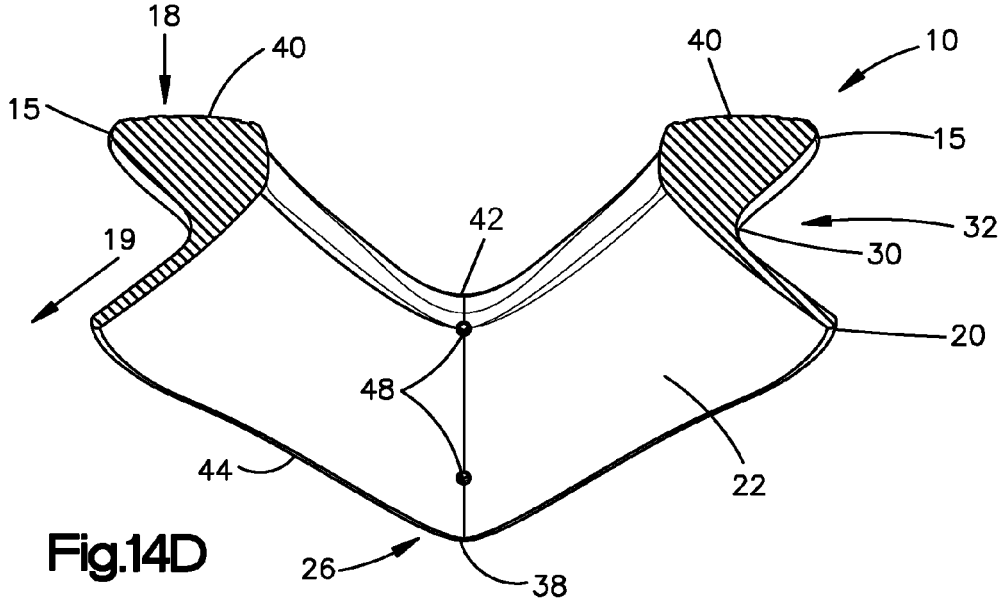
FIG. 14D is a cross section of a cervical spine protection device according to an embodiment of the present invention along line 14D-14D of FIG. 14A.
Figure 15:
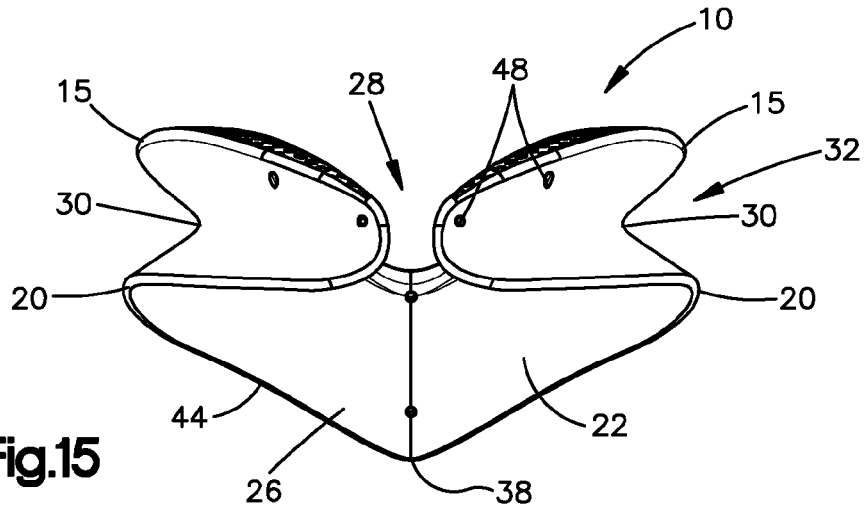
FIG. 15 is a front view of a cervical spine protection device according to an embodiment of the present invention.
Figure 16:
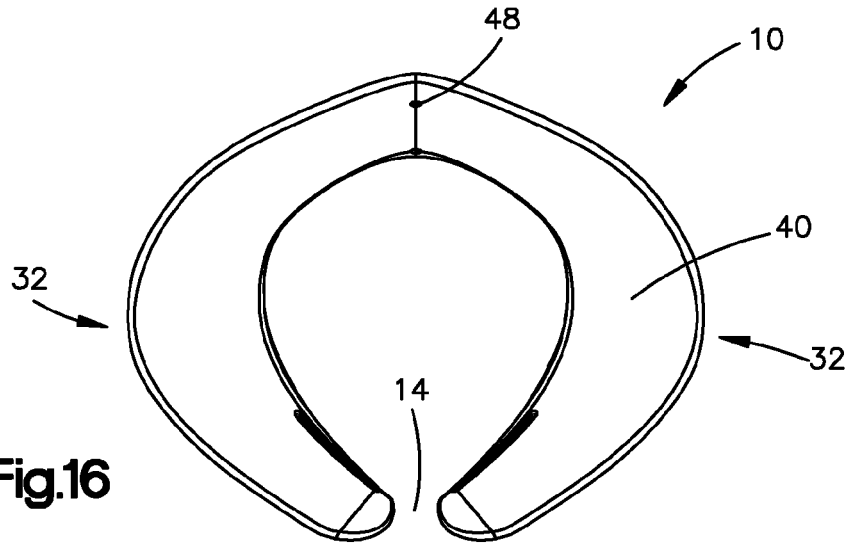
FIG. 16 is a top view of a cervical spine protection device according to an embodiment of the present invention.
Figure 17:
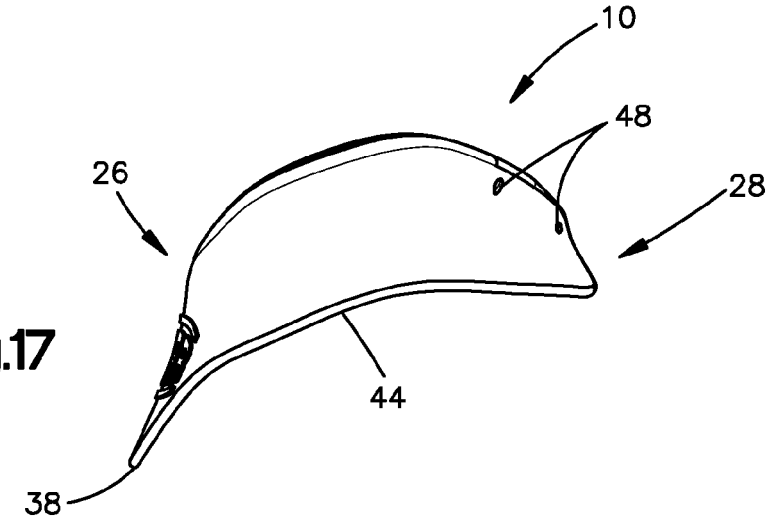
FIG. 17 is a side view of a cervical spine protection device according to an embodiment of the present invention.

The protection device 10 of the embodiments of the present invention is designed to be worn in conjunction with a helmet, which may be a football helmet 11, and shoulder pads, which may be football shoulder pads 23. The shape of the protection device 10 of the embodiments of the present invention is provided to accommodate the normal anatomy of the upper back and lower cervical spine of a human being. The device 10 includes an inside portion 22 and an outside portion 24, where the inside portion 22 is designed and shaped/contoured to fit around the neck of a user (see FIGS. 1, 3 and 4), and the outside portion 24 is shaped/contoured to engage with shoulder pads 23 (see FIGS. 7 and 8).

At a back portion 26 of the device 10 according to an embodiment of the present invention, there is a back opening 12 and similarly there is a front opening 14 at a front portion 28 of the device 10. The purpose of these openings is to allow unrestricted movement of the head and neck during athletic movement. The device 10 also includes a middle portion 30 located in a generally centralized elevational position of the device 10, upper portions 15 that extend toward the lower edge 34 of the helmet 11, and lower portions 20 that are shaped/contoured to rest on the shoulders of the user and fit adjacent to/under shoulder pads 23. Further, the device 10 includes side portions 32 in-between the back and front portions 26, 28. The back opening 12 is preferably shaped such that a maximum width of the opening 12 is substantially equal to the width of a user's neck. One skilled in the art will recognize that the width of a user's neck varies depending upon the sex of the user, age of the user, athletic ability of the user, fat content of the user, muscle content of the user, and the like. One skilled in the art will recognize that the embodiments of the present invention may be sized to fit any variations of the above depending upon the application.

The focus of the embodiments of the present invention is to absorb the force of an impact at the top 36 of the head and/or helmet 11. Most catastrophic injuries in contact sports occur when the head is driven down toward the neck and shoulders producing pressure too great for the cervical spine to handle. This extreme pressure can cause a buckling of the spinal column and can lead to disc herniation, muscle and ligament damage, and severe spinal cord injury. The protective device 10 of the embodiments of the present invention provides the necessary support in order to minimize spinal cord injury that could result from excessive force being applied to the top 36 of a player's head and/or helmet 11, while at the same time allowing freedom of movement for the head and neck.

Figure 5:
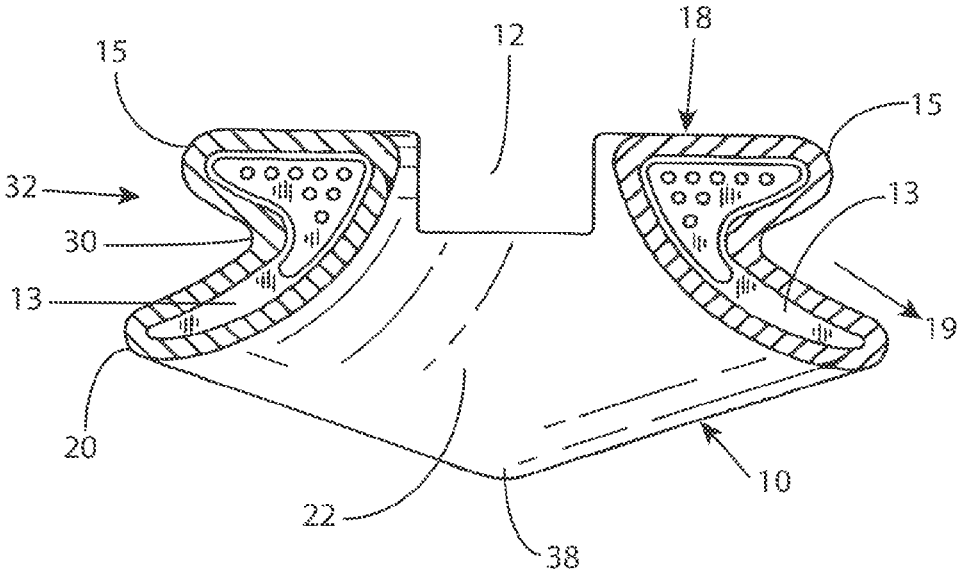
FIG. 5 is a cross section of a cervical spine protection device according to an embodiment of the present invention along line A-A of FIG. 2 showing compression elements embedded in the protection device.
Figure 6:
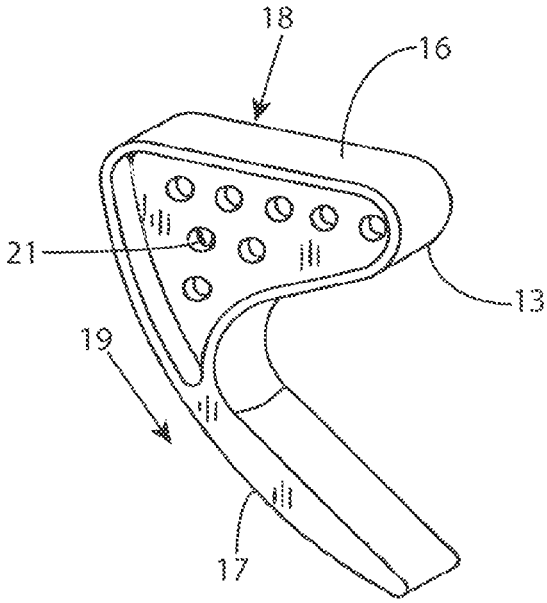
FIG. 6 is a front/side perspective view of a compression element included in a cervical protection device according to an embodiment of the present invention.

An embodiment of the present invention includes compression elements 13. More particularly, FIG. 6 illustrates a compression element 13, which is inserted within an embodiment of the device 10 as shown in FIG. 5. FIG. 5 is a cross-section looking toward the back portion 26 of an embodiment of the device 10 illustrating how the compression element 13 is inserted within the device 10. FIG. 4 is a side view of an embodiment of the device 10 illustrating how a plurality of compression elements 13 may extend around the periphery of device 10 according to an embodiment of the present invention. FIG. 4 shows three individual compression elements 13 on the side portions 32 of device 10, but it is to be understood that a greater or lesser number can be used depending on the degree of support required. For example, and as explained herein, an embodiment of the present invention does not include any compression elements 13—that is, the device 10 itself and its unique shape act as the compression element.

In an embodiment of the present invention that includes compression elements 13, the compression element 13 can be made from a stiff polyurethane material (or any similar material) that can provide adequate support. The upper surface 16 of the compression elements 13 is designed to support the upper surface 40 of the upper portions 15 to provide a generally wide contact area that may receive the lower edges 34 of the helmet 11 when excessive force is applied to the top 36 of the helmet 11. The width of this contact area on the upper portions 15 can vary depending on the type of helmet worn by the player. For example, the width may be in the approximate range of 2 to 4 inches wide at the widest point. However, the width may be wider (e.g., 4 inches or larger), and is not limited to the sizes disclosed herein.

The lower surface 17 of the compression elements 13 is designed to follow the contours of the player's neck and is specifically shaped to direct force away from the cervical spinal column. This is illustrated by arrow 18 representing a downward force applied to the upper surface 16 when an excessive force is received at the top 36 of the head and/or helmet 11, forcing the lower edges 34 of the helmet 11 onto upper portions 15 of the device 10. This force is then directed from a downward direction as shown by arrow 18 to an oblique direction as shown by arrow 19. Apertures 21 shown in FIG. 6 are illustrative only and can be used, if necessary, to reduce the weight of compression element 13 or for other reasons known to those of ordinary skill in the art, such as securing the device 10 to shoulder pads 23.

As stated above, an embodiment of the present invention does not include compression elements as shown in FIG. 6, but rather the function of the compression element is performed by the material and shape of the device itself. For example, an embodiment of the present invention may include a device 10 that is molded as one-piece out of a synthetic material or the like (for example, foam or the like). This material is preferably selected such that the device 10 can provide adequate support without a separate compression element present. In the embodiments of the present invention that do not include separate compression elements, the upper portions 15 are shaped with an upper surface 40 to provide a generally wide contact area that may receive the lower edges 34 of the helmet 11 when excessive force is applied to the top 36 of the helmet 11. Again, the width of this contact area on the upper portions 15 can vary depending on the type of helmet worn by the player. For example, the width preferably is in the approximate range of 2 to 4 inches wide at the widest point.

The middle portion 30 and the lower portion 20 of the device 10 are designed to follow the contours of the player's neck and are specifically shaped to direct force away from the cervical spinal column. This is illustrated by arrow 18 representing a downward force applied to the upper surface 16 when an excessive force is received at the top 36 of the head and/or helmet 11, forcing the lower edges 34 of the helmet 11 onto upper portions 15 of the device 10. This force is then directed from a downward direction as shown by arrow 18 to an oblique direction as shown by arrow 19.

As set forth above, the embodiments of the present invention are designed to protect against spinal cord injury when excessive force is applied to the top 36 of a player's helmet 11, which can result in axial compression of the spine. Injury is minimized by filling the gap between the lower edge 34 (bottom sides and back bottom) of a player's helmet 11 and the lower neck and upper shoulder of the player with the device 10. In an embodiment of the present invention, force directed at the top 36 of the helmet 11 is applied to the device 10 at the upper portion 15 and absorbed by the compression elements 13, which direct the force way from the cervical spine. In another embodiment of the present invention, force directed at the top 36 of the helmet 11 is applied to the device 10 at the upper portion 15 and absorbed by the device 10 itself (through its unique shape and its material), where the device 10 directs the force away from the cervical spine. The disclosed embodiments of the present invention also allow unrestricted movement of the head and neck during athletic activity.

The shape of the device 10 of the embodiments of the present invention, as shown in the figures, will now be described in more detail. As shown in FIG. 3, the back portion 26 of the device 10 preferably includes a substantially v-shaped design 38. In an embodiment of the present invention, the back portion of the device 26 also includes an opening 12 that is sized and shaped to allow a person wearing a device 10 and a helmet 11 to move their head and neck backwards (toward their back and away from their chest) without substantial restriction. The opening 12 creates a valley 42 in the back portion 26, which is at a lower point elevationally than the top surface 40 of the upper portion 15 of the device 10 (as shown in FIG. 5). In other words, when wearing the device 10 and a helmet 11, the upper portions 15 would be closer to the lower edge 34 of the helmet 11 than the valley 42 of the back portion 26 (as is evident from FIGS. 1 and 3). Therefore, if a user (for example, a football player) was wearing the device 10 and a force was applied to the top 36 of the user's head and/or helmet 11, the valley 42 is at an elevation such that the lower edge 36 of the helmet 11 would contact the top surface 40 of the upper portion 15, and not the valley 42 of the back portion 26. Therefore, the opening 12 at the back portion 26 of the device 10 (as used throughout this description) is not necessarily an "opening," but rather, the opening 12 may simply be describing the back portion 26 of the device 10 having a lower surface elevationally than the top surface 40 of the upper portion 15. One skilled in the art will understand that the opening 12 assists in allowing extension of the head and neck during athletic movement when a user is wearing the device 10.

As discussed herein, the device 10 is shaped to direct a force occurring at the upper portions 15 (this force is shown by arrow 18, i.e., a force in a downward direction on the top surface 40 of the upper portion 15) away from the cervical spine (the redirected force is shown by arrow 19, i.e., an oblique direction). As depicted in FIGS. 1-3 and 5, the outside portion 24 of the device 10 includes a substantially c-shaped design, with the lower portions 20 and the upper portions 15 extending laterally further than the middle portion 30 of the device 10. In an embodiment of the present invention, the lower portions 20 are shaped to fit comfortably on the shoulders of a user beneath the shoulder pads that are typically worn by athletes (for example, football players), as is apparent from the shape of the device 10. The upper portions 15 include a top surface 40 that extends from the inside portion 22 of the device 10 to the edge of the side portions 32 of the device 10 beyond the middle portion 30 of the device 10. In an embodiment of the present invention, the upper portions 15 do not extend as far as the lower portions 20, and the upper portions 15 are shaped to fit above the shoulder pads that are typically worn by football players (as is apparent from the shape of the device 10). In an embodiment of the present invention, the shape of the device 10 assists in directing a force occurring at the upper portions 15 (arrow 18, i.e., a downward direction) away from the cervical spine (arrow 19, i.e., an oblique direction).

While there has been described what is considered to be a preferred embodiment of the invention, it will be understood by those skilled in the art that various changes and modifications may be made therein without departing from the invention, and therefore, it is the aim of the appended claims to cover all such changes and modifications as fall within the true spirit and scope of the invention.

The device 10 according to the embodiments of the present invention was created with the simple knowledge in mind that the head is connected to the neck. The forces generated during impact from the head to the neck need to be absorbed, or lessened, in some way. For example, in the context of football, as helmets collide, the force that is generated from that collision goes directly from the helmets to the head and into the spine. Without the presence of the device 10 according to the embodiments of the present invention, there is nothing to absorb those forces. The embodiments of the present invention are preferably constructed in order to achieve a balance between flexibility and stability where it is needed.

An embodiment of the present invention includes a device 10 (collar) with a streamlined base 44. A device 10 according to an embodiment of the present invention also includes flexibility. In an embodiment of the present invention, the streamlined base 44 and the flexibility of the device 10 are present such that the device 10 can fit into shoulder pads, for example, football shoulder pads 23. Specifically, in this embodiment, the streamlined base 44 is present to hold the device 10 in place into the shoulder pads 23, and is designed for comfort and movement when a sports player is playing their respective sport (for example, the flexibility provides increased movement and comfort for a user). In an embodiment of the present invention, the streamlined base 44 and the flexibility of the device 10 are not part of the compressive element of the device 10. In another embodiment of the present invention, the streamlined base 44 and the flexibility of the device 10 are part of the compressive element of the device 10.

The devices 10 according to the embodiments of the present invention are designed such that they do not restrict the range of motion at all during play. In other words, a user of the device 10 of the embodiments of the present invention will be able to move their head from side to side, front to back, and will be able to turn their head as they normally would without the device 10 present during play. However, when a user of the embodiments of the present invention makes contact with their head in a way that would compress the spine without the device 10 present (for example, a football player hitting another player with the top 36 of their helmet 11), as a user makes contact, the helmet 11 of a user is forced to make contact with the upper portion 15 of the device 10. The upper portion 15 of the device 10 absorbs some of the forces that are generated during impact and deflects/distributes some of the forces that are generated during impact away from the head and neck area.

In an embodiment of the present invention, when a user is wearing the device 10, and is in a "football position," a user is able to move around. It is only at the point of impact, i.e., when a user braces for a hit or makes contact, that the device 10 according to the embodiments of the present invention engages the bottom of the helmet 11.

Another embodiment of the present invention includes an opening 12 in the back portion 26 of the device 10, and therefore, there is nothing that restricts the movement of a user's head from moving backwards when wearing the device 10. When a player experiences impact, it is important that the player's head is not restricted from moving backward so that the head can travel away from an opposing force. The embodiments of the present invention are designed to limit axial loading on the head and neck during impact. As a force comes down on a user's head, the embodiments of the present invention reduce some of the axial load force while allowing the user's head to travel backwards, which allows a disbursement of some of the forces generated during impact.

As stated above, the device 10 according to the embodiments of the present invention preferably works in conjunction with shoulder pads 23. Specifically, a device 10 according to an embodiment of the present invention preferably fits into shoulder pads 23. An embodiment of the present invention is contoured to fit directly into a pair of shoulder pads 23. The device 10 is preferably further secured into the shoulder pads 23 to make sure the device 10 stays in place during use. The securing of the device 10 is preferably accomplished through a securing means or fastening means which may include snaps, a lace/string/tie, Velcro (i.e., hook and loop), tape (or other adhesive), clamps, clips, couplings, docks, hooks, latches, pins, buttons, slides, tongue and groove attachments, or the like.

In an embodiment of the present invention that includes laces, the device 10 is contoured to fit directly into a pair of shoulder pads 23 and then is laced to the shoulder pads 23 to make sure the device 10 stays in place. In other words, attachment of the device 10 for use includes tying the device 10 into a pair of shoulder pads 23 using a "tie-in" system comprising, for example, three to six laces to fasten the device 10 to the shoulder pads 23. By way of an example, the following describes how an embodiment of the present invention that includes laces 46 can be fit into a pair of shoulder pads 23. The opening 14 of the device 10 is preferably aligned with the opening (front) 25 of the shoulder pads 23. The device 10 may then be laced into the shoulder pads 23 through tying the device 10 into position using the laces 46. In an embodiment of the present invention, the front of the device 10 includes laces 46 for tying around/through shoulder pads 23. Additionally, an embodiment of the present invention may include laces 46 at the back of the device 10 for tying around/through shoulder pads 23 (or at both the front and back of the device 10). An embodiment of the present invention may include additional laces as well for extra stability. An embodiment of the present invention may also include holes 48 in which the laces 46 may be threaded through.

When the device 10 according to an embodiment of the present invention is correctly engaged with the shoulder pads 23, the device 10 is preferably open in the front 28, the sides 32 are preferably adjacent to the inside side portions 27 of the shoulder pads 23, and the back portion 26 of the device 10 is preferably below or even with the top back portion 29 of the shoulder pads 23. The inside 22 side portions 32 of the device 10 preferably touch a user's neck when a user is wearing the shoulder pads 23 with the device 10 engaged therewith. The device 10 preferably does not indent the user's neck, but rather the device 10 should barely touch the skin. The device 10 is contoured to fit streamlined into the shoulder pads 23 in order not to change the shape of the shoulder pads 23 and to work better with the shoulder pads 23.

Another embodiment of the present invention includes a cervical spine protection device as described herein that is integral with a pair of shoulder pads. In other words, the protection device is a part of the shoulder pads themselves, and not a separate element.

Only at the point of impact does the device 10 engage the bottom 34 of the helmet 11 in order to absorb and distribute the force of an impact (hit) away from the neck and spine of a user. During normal play and physical activity, however, the device 10 preferably does not restrict movement of the user at all.

The device 10 according to the embodiments of the present invention is designed to absorb some of the impact to the head, neck, and spine during collision. There is no device, however, that can absorb all of the forces during impact, and a user should not think that once they have the device 10 in place during sport, they are immune to injury to the head or neck. In other words, a person wearing the device 10 may still sustain an injury to the head, neck, and spine during collision.

The design 10 of the embodiments of the present invention preferably includes flexibility such that the device 10 is flexible in nature, and is able to move back and forth and side to side. The device 10 can be comfortably worn by a user during play because of its flexibility and shape.

As stated above, an embodiment of the present invention does not include compression elements, but rather the function of the compression element is performed by the material and shape of the device 10 itself. The material is preferably selected such that the device 10 can provide adequate support without a separate compression element present. A preferred embodiment of the present invention is constructed of a material similar to "smartLite®" or the like (foam made of a thermoplastic, polyester, or polyether). The material in a preferred embodiment of the present invention includes a microcellular structure, which can include open cells and/or closed cells (microscopic). The closed cells do not allow for the penetration of, for example, water or other liquids. For example, the outside surfaces of the device 10 in a preferred embodiment of the present invention include manufacturing such that perspiration, water, dirt, and the like cannot be absorbed into the material of the device 10. As stated herein, the density of the material may vary, and the density is not restricted to certain values for the embodiments of the present invention. An example of the density of the material of the device 10 is 0.50 g/cc to 1.00 g/cc, but a person of ordinary skill in the art will recognize that the density may be greater than this value, or lower than this value. The material may be injection molded to form the embodiments of the present invention. The injection molding process allows the material to closely mimic the surface texture of the mold, which can allow for different surface finishes in the embodiments of the present invention. The material in a preferred embodiment of the present invention allows for the device to have a hardness in the range of 35-55 ShA, but a person skilled in the art will understand that embodiments of the present invention include devices with higher or lower Shore A values.

In addition to the embodiments of the present invention optionally including different and/or varying densities, embodiments of the present invention include devices 10 that have different and/or varying flexibility and/or elasticity. For example, a preferred embodiment of the present invention includes a device 10 with an upper portion 15 that includes more material than the lower portion 30. This design allows for more elasticity and flexibility of the lower portion 20 compared to the upper portion 15. Another embodiment of the present invention includes a device 10 with an upper portion 15 that includes more material than the middle portion 30, which in turn includes more material than the lower portion 20.

In a contact sport with shoulder pads 23, before and during impact, the shoulders typically rise up, and thus the shoulder pads 23 rise up, and the base 34 of the helmet 11 of a player hits the device 10 according to the embodiments of the present invention when a user is wearing the device 10.

The embodiments of the present invention may be used to prevent the injury commonly referred to as a "stinger." This is because the embodiments of the present invention distribute the force of impact away from the neck and spine.

The embodiments of the present invention are directed to a device 10 that may be used by a player engaged in sport. For example, the embodiments of the present invention may be used when playing the following sports: football (for example, American football), lacrosse, hockey, water polo, wrestling, sumo, martial arts, boxing, or the like. One skilled in the art will understand that the device 10 according to embodiments of the present invention may be used in any activity or walk of life in order to aid in the prevention of spine/neck injury. As used throughout this application, "player" or "user" may be any person attempting to prevent or limit the risk of spine/neck injury. While "football" is discussed for use of the device 10 throughout this application, one of ordinary skill will recognize that the embodiments of the present invention are not limited for use by football players. Therefore, the shoulder pads and helmet discussed throughout this application may be in the form of shoulder pads/helmets used in sports other than football (e.g., lacrosse, hockey, or the like).

An embodiment of the present invention provides critical protection without hindering player performance.

In an embodiment of the present invention, the low profile design creates a natural fit into shoulder pads 23.

The device 10 according to the embodiments of the present invention can lower head accelerations resulting from a top impact. The device 10 according to the embodiments of the present invention can also reduce force transmission through the neck. In a top impact, the device 10 redirects some of the load to the shoulders, on which the device 10 rests. The stiffness of the device 10 prevents the neck from further compression. The device 10 also provides protection during an impact to the front of the head and/or helmet 11. The device 10 can reduce upper neck moment and lower neck force in all configurations. The device 10 also can reduce the lower neck moment in a raised configuration. The device 10 according to an embodiment of the present invention restricts the range of motion of the head and neck by contacting the base 34 of the helmet 11 during an impact (this is observable during high-speed video). This contact between the helmet 11 and device 10 is responsible for lower loads.

The device 10 according to the embodiments of the present invention will typically perform better in the raised position (when a user's shoulders are raised upward) because the helmet 11 will contact the device 10 sooner and restrict more motion. In a side impact, the device 10 according to the embodiments of the present invention may reduce a lower neck moment. Again, this is due to the base 34 of the helmet 11 contacting the device 10, restricting the range of motion. This movement restriction is most noticeable in a high speed video. The device according to the embodiments of the present invention is designed to contact the base 34 of the helmet 11, which restricts motion of the head and neck during impact. Restriction of motion during impact correlates with load reductions.

With a front impact location, the device 10 can reduce lower neck moment, and the device 10 is also capable of reducing lower neck force and upper neck moment. With a side impact location, the device 10 can produce lower neck moment reductions.

An embodiment of the present invention includes a molded synthetic collar (the device 10) that rests on the shoulders and gets engaged with (for example, laced into) shoulder pads 23.

In an embodiment of the present invention that includes a compressive element, the density of the compressive element can range from 0.35 to 0.65 grams per cubic centimeter squared. Similarly, in a preferred embodiment of the present invention that does not include a compressive element, the density of the device can range from 0.35 to 0.65 grams per cubic centimeter squared. One skilled in the art will readily understand that the embodiments of the present invention are not limited to the densities disclosed herein.

In an embodiment of the present invention that includes a compressive element, the compressive element may use a methyline Di isolate (MDI) skin polyurethane. Similarly, in a preferred embodiment of the present invention that does not include a compressive element, the device may use a methyline Di isolate (MDI) skin polyurethane.

As will be understood by one of ordinary skill in the art, the device 10 of the embodiments of the present invention can be worn with any shoulder pads used in contact sports, and are not limited to football shoulder pads.

In an embodiment of the present invention that includes a compressive element, the compressive element may include data recording devices imbedded inside such as compression measuring sensors, accelerometers, or similar (and/or any combination of data recording devices). Similarly, in a preferred embodiment of the present invention that does not include a compressive element, the device may include data recording devices imbedded inside such as compression measuring sensors, accelerometers, or similar (and/or any combination of data recording devices).

The embodiments of the present invention further include the methods of making the devices 10 as described herein. For example, a device 10 according to an embodiment of the present invention is made through an injection molding process in which there is a cavity that is shaped to form the device 10 as described herein. In this injection molding process, the material of the device 10 is fed into a heated barrel, mixed, and forced into a mold cavity where it cools and hardens to the configuration of the cavity. In a preferred embodiment of the present invention that does not include a compressive element, the device may be made through a single injection molding process. Also, one of ordinary skill will recognize that different materials may be used during the injection molding process, particularly for embodiments of the present invention that include varying densities throughout the device. In an embodiment of the present invention that includes a compressive element, the compressive element may be injection molded in one step, with material added around the compressive element through a second step in the injection molding process. In contrast, the compressive element may be constructed using any process known by those of ordinary skill in the art for forming, for example, plastic parts.

The injection molding process of the embodiments of the present invention may further or alternatively include a non-aggressive screw, a barrel and nozzle temperature of up to 180° C., temperature controls, a non-return valve (which may be on hydraulics to retain pressure on the screw after charging to avoid expansion in the barrel and gas loss), a shut-off nozzle (not restricting the flow; to prevent gas escape through the nozzle and melt drool; hydraulically or pneumatically operated nozzles are preferred over the mechanically activated spring types), and a mold temperature control between 15 and 50° C.

Additional methods of manufacturing the device 10 according to embodiments of the present invention include extrusion, flow molding, thermoforming, physical shaping, or the like.

The embodiments of the present invention further include the methods of using the devices 10 as described herein. For example, a user preferably fastens/secures the device 10 according to the embodiments of the present invention to shoulder pads 23 using one of the fastening means described herein, for example, laces 46. Alternatively, a user may simply put on the embodiment of the present invention in which the device 10 is integral with the shoulder pads 23. A user then preferably wears a helmet 11 before engaging in physical activity.

I claim:

1. A cervical spine protection device comprising:

a lower portion engaged with a user's shoulders;

an upper portion designed for engagement with a user's head protection device when an axial force is applied to a portion of the user's head protection device, the upper portion having a front section, a rear section, and side sections, wherein the front section, rear section, and side sections of the upper portion have a top surface;

a middle portion disposed between the lower portion and the upper portion;

an inside portion shaped to fit around a user's neck, an outside portion shaped to engage with shoulder pads, wherein the outside portion comprises a substantially c-shaped design, with the lower portion and the upper portion extending laterally further than the middle portion away from the user's neck, wherein the top surface of the side sections of the upper portion has an apex that is higher than the top surface of the front section and the rear section when the cervical spine protection device is worn by a user, wherein the axial force applied to the portion of the user's head protection device is at least partially absorbed by the cervical spine protection device and at least partially directed away from a cervical spinal column of the user by the cervical spine protection device, and wherein the cervical spine protection device allows extension of the head and neck during athletic movement.

2. The device according to claim 1, wherein the lower portion is shaped to fit adjacent to or under shoulder pads.

3. The device according to claim 1, wherein the top surface of the upper portion provides a contact area that receives a bottom surface of the user's head protection device when an axial force is applied to a portion of the user's head protection device.

4. The device according to claim 1, wherein the lower portion is shaped to follow the contours of a user's neck and shoulders, and wherein the lower portion is shaped to direct an axial force away from the cervical spinal column.

5. The device according to claim 1, further comprising a tapered portion on the lower portion designed to follow the contours of a user's neck and shoulders, wherein a force applied to the top surface of the upper portion is directed along the tapered lower portion away from the user's cervical spinal column in an oblique direction.

6. The device according to claim 1, wherein the upper portion comprises a width that is in the range of between 2 to 4 inches in length.

7. The device according to claim 1, wherein the cervical spine protection device comprises plastic, polyurethane, or foam.

8. The device according to claim 1, wherein the lower portion comprises an opening at a forward facing side of the user's body.

9. The device according to claim 1, further comprising an opening in the upper portion at the rearward facing side of a user's body that is of a width substantially equal to the width of a user's neck.

10. The device according to claim 1, further comprising openings at forward and rearward facing sides of a user's body that are sufficient in size to allow substantially unrestricted movement of a user's head and neck.

11. The device according to claim 1, further comprising a means for fastening, wherein the means for fastening is capable of engaging the device with shoulder pads.

12. The device according to claim 11, wherein the means for fastening comprises laces, snaps, hook and loop, tape, clamps, clips, couplings, docks, hooks, latches, pins, buttons, slides, or tongue and groove attachments.

13. The device according to claim 1, wherein the upper portion comprises a width that is wider at the side portions than at the rear portion.

14. A cervical spine protection system comprising:

shoulder pads;

a cervical spine protection device comprising a lower portion engaged with a user's shoulders;

an upper portion designed for engagement with a user's helmet when an axial force is applied to a portion of the helmet, the upper portion having a front section, a rear section, and side sections, wherein the front section, rear section, and side sections of the upper portion have a top surface;

a middle portion disposed between the lower portion and the upper portion;

an outside portion shaped to engage with shoulder pads, wherein the outside portion comprises a substantially c-shaped design, with the lower portion and the upper portion extending laterally further than the middle portion away from the user's neck, an inside portion shaped to fit around a user's neck, wherein the top surface of the side sections of the upper portion has an apex that is higher than the top surface of the front section and the rear section when the cervical spine protection device is worn by a user, wherein the axial force applied to the top portion of the helmet is at least partially absorbed by the cervical spine protection device and at least partially directed away from a cervical spinal column of the user by the cervical spine protection device, and wherein the cervical spine protection device allows extension of the head and neck during athletic movement.

15. The system according to claim 14, wherein the lower portion is shaped to fit adjacent to or under the shoulder pads.

16. The device according to claim 14, wherein the cervical spine protection device is integral with the shoulder pads.

17. A cervical spine protection device comprising:

an inside portion shaped to fit around a user's neck;

an outside portion comprising an upper portion, a lower portion, and a middle portion, wherein the middle portion is located between the upper portion and the lower portion;

a front section;

a rear section; and side portions, wherein the front section, rear section, and side sections have a top surface, wherein the top surface of the side sections has an apex that is higher than the top surface of the front section and the rear section when the cervical spine protection device is worn by a user, wherein the lower portion is shaped to engage with a user's shoulders, wherein the rear section includes an opening that is sized and shaped to allow a user to move their head and neck backwards without substantial restriction, wherein the outside portion comprises a substantially c-shaped design, with the lower portion and the upper portion extending laterally further than the middle portion away from the user's neck, and wherein, when a force is applied to the top surface of the upper portion, the device directs the force away from the user's cervical spine.

18. The device according to claim 17, wherein the inside portion includes a tapered lower portion designed to follow contours of the user's neck, and wherein the force applied to the top surface of the upper portion is directed along the tapered lower portion away from the user's cervical spine.

19. The device according to claim 17, wherein the lower portion extends laterally further away from the user's neck than the upper portion.

20. The device according to claim 17, wherein the upper portion is shaped to fit above shoulder pads, and the lower portion is shaped to fit beneath shoulder pads.

21. The device according to claim 17, wherein the top surface is designed to engage a bottom surface of a helmet when a force is applied to a top of the helmet.

22. A cervical spine protection device comprising:

a foam material that includes at least an open cell microcellular structure;

an inside portion shaped to fit around a user's neck;

an outside portion comprising an upper portion, a lower portion, and a middle portion, wherein the middle portion is located between the upper portion and the lower portion;

a front section;

a rear section; and side sections, wherein the front section, rear section, and side sections have a top surface wherein the top surface of the side sections has an apex that is higher than the top surface of the front section and the rear section when the cervical spine protection device is worn by a user, wherein the upper portion includes more material than the lower portion, wherein the lower portion is more flexible than the upper portion, wherein the lower portion is shaped to engage with a user's shoulders, wherein the rear section includes an opening that is sized and shaped to allow a user to move their head and neck backwards without substantial restriction, wherein the outside portion comprises a substantially c-shaped design, with the lower portion and the upper portion extending laterally further than the middle portion away from the user's neck, and wherein, when a force is applied to the top surface of the upper portion, the device acts as a compressive element and directs the force away from the user's cervical spine.

* * * * *